US009924780B2

(12) United States Patent
Park

(10) Patent No.: US 9,924,780 B2
(45) Date of Patent: Mar. 27, 2018

(54) BAG HAVING ADJUSTABLE SHOULDER STRAP, SHOULDER STRAP ASSEMBLY AND PIVOTALLY CONNECTING DEVICE USED FOR THE SAME

(71) Applicant: Sol Park, Seoul (KR)

(72) Inventor: Sol Park, Seoul (KR)

( * ) Notice: Subject to any disclaimer, the term of this patent is extended or adjusted under 35 U.S.C. 154(b) by 316 days.

(21) Appl. No.: 14/425,655

(22) PCT Filed: Sep. 5, 2013

(86) PCT No.: PCT/KR2013/008028

§ 371 (c)(1),
(2) Date: Apr. 30, 2015

(87) PCT Pub. No.: WO2014/038870

PCT Pub. Date: Mar. 13, 2014

(65) Prior Publication Data

US 2015/0223587 A1 Aug. 13, 2015

(30) Foreign Application Priority Data

Sep. 5, 2012 (KR) ..... 10-2012-0098352

(51) Int. Cl.
*A45C 15/00* (2006.01)
*A45F 3/04* (2006.01)
(Continued)

(52) U.S. Cl.
CPC ..... *A45F 3/047* (2013.01); *A44B 11/266* (2013.01); *A45C 13/30* (2013.01); *A45F 3/04* (2013.01);
(Continued)

(58) Field of Classification Search
CPC ..... A45F 3/047; A45F 3/04; A45F 2003/142; A45F 2003/001; A44B 11/266; A44B 11/006; A45C 13/30
(Continued)

(56) References Cited

U.S. PATENT DOCUMENTS 5,319,836 A * 6/1994 Ida ..... A44B 11/263 24/614
5,361,953 A 11/1994 Nichols
(Continued)

FOREIGN PATENT DOCUMENTS

| | | |
|---|---|---|
| JP | 3393330 B2 | 1/2003 |
| KR | 0392083 | 8/2005 |
| KR | 100572526 | 4/2006 |

*Primary Examiner* — Adam Waggenspack
*Assistant Examiner* — Lester L Vanterpool
(74) *Attorney, Agent, or Firm* — Davis & Bujold PLLC; Michael J. Bujold

(57) ABSTRACT

The present invention provides a bag with adjustable shoulder straps includes: an accommodating unit having an internal space capable of keeping an object; a first upper strap and a second upper strap each being connected to both sides of an upper portion of the accommodating unit, respectively; a first lower strap and a second lower strap each being connected to both sides of a lower portion of the accommodating unit; a first coupling module coupling the first upper strap to the first lower strap to be rotatable and having a first locking portion; and a second coupling module coupling the second upper strap to the second lower strap to be rotatable and having a second locking portion detachably locked to the first locking portion, and a shoulder strap assembly and a rotary type coupler for the bag.

13 Claims, 5 Drawing Sheets

(51) Int. Cl.

| | |
|---|---|
| ***A45C 13/30*** | (2006.01) |
| ***A44B 11/26*** | (2006.01) |
| *A45F 3/00* | (2006.01) |
| *A45F 3/14* | (2006.01) |
| *A44B 11/00* | (2006.01) |

(52) U.S. Cl.
CPC ..... *A44B 11/006* (2013.01); *A45F 2003/001* (2013.01); *A45F 2003/142* (2013.01)

(58) Field of Classification Search
USPC ..... 224/579, 578; 24/307
See application file for complete search history.

(56) References Cited

U.S. PATENT DOCUMENTS

| | | | | |
|---|---|---|---|---|
| 5,860,769 | A * | 1/1999 | Seligman | A44B 11/263 224/264 |
| 6,457,620 | B1 * | 10/2002 | Batten | A63B 55/408 206/315.3 |
| 6,695,269 | B1 | 2/2004 | Anscher | |
| 7,198,183 | B2 * | 4/2007 | Yang | A45F 3/12 206/315.3 |
| 7,513,018 | B2 * | 4/2009 | Koenig | B60P 7/0823 224/258 |
| 2004/0221373 | A1 * | 11/2004 | Lee | A45C 13/30 2/268 |
| 2005/0184112 | A1 * | 8/2005 | Copich | A45F 3/20 224/148.2 |
| 2007/0175940 | A1 | 8/2007 | Sacks | |

* cited by examiner

[FIG. 1]
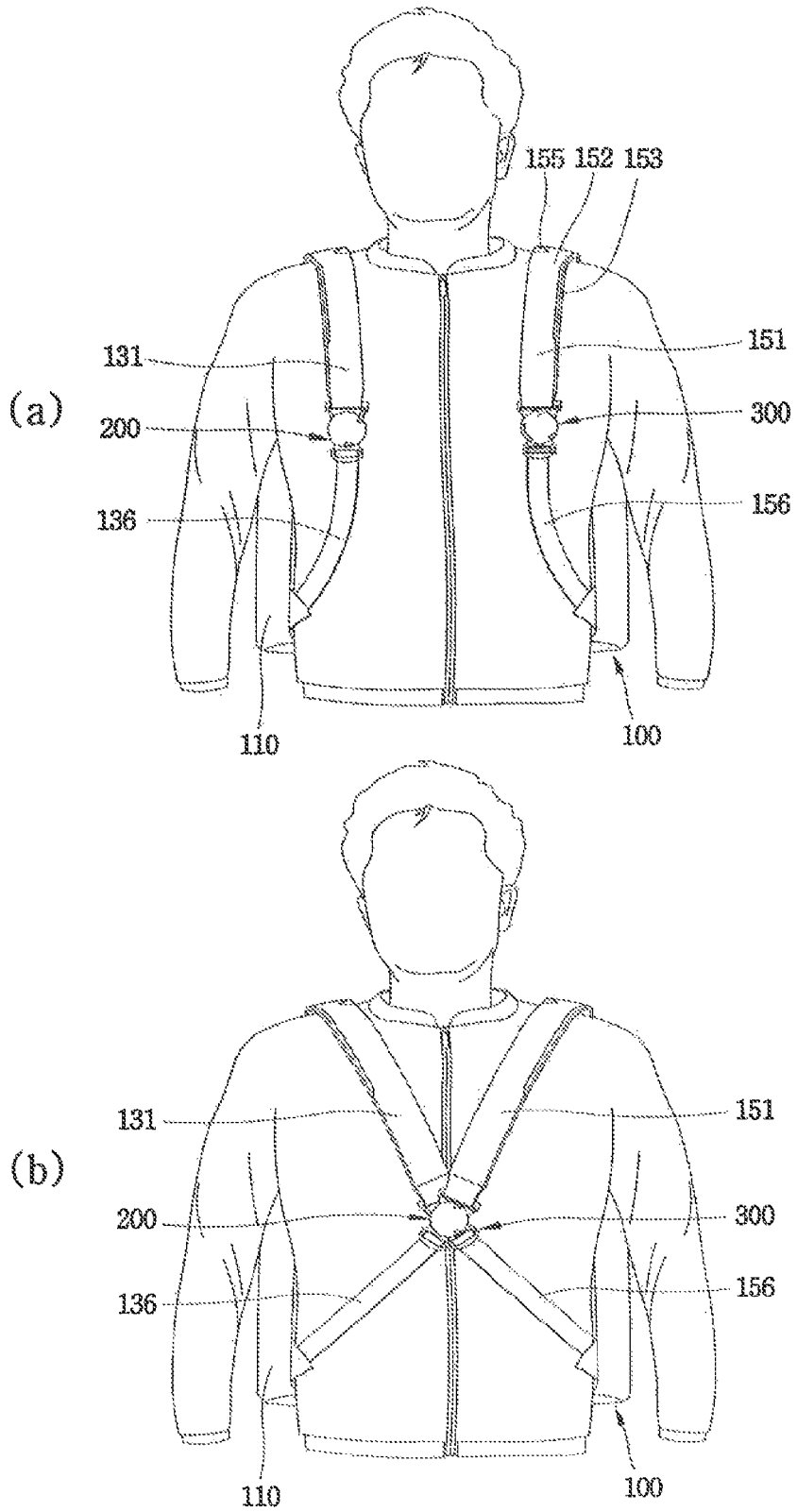

[FIG. 2]
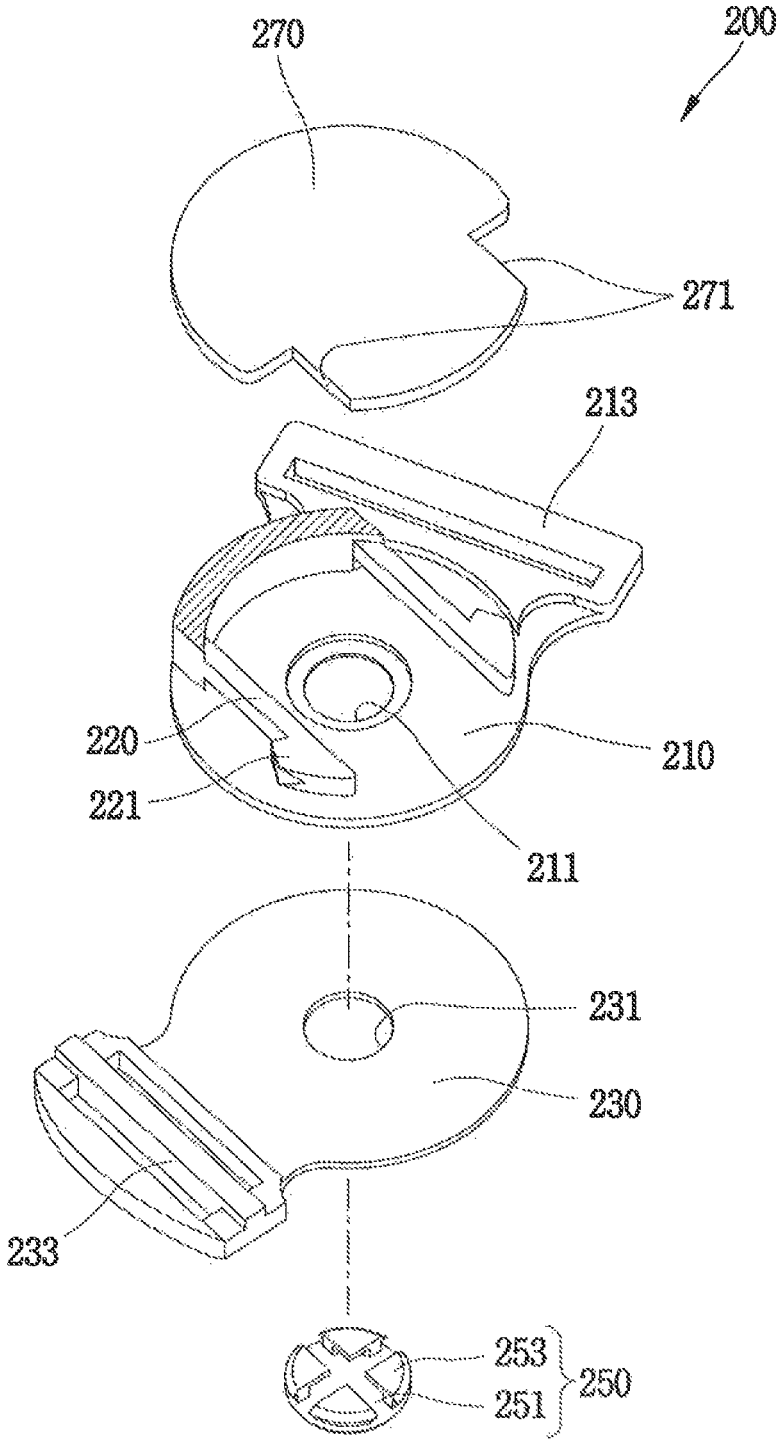

[FIG. 3]
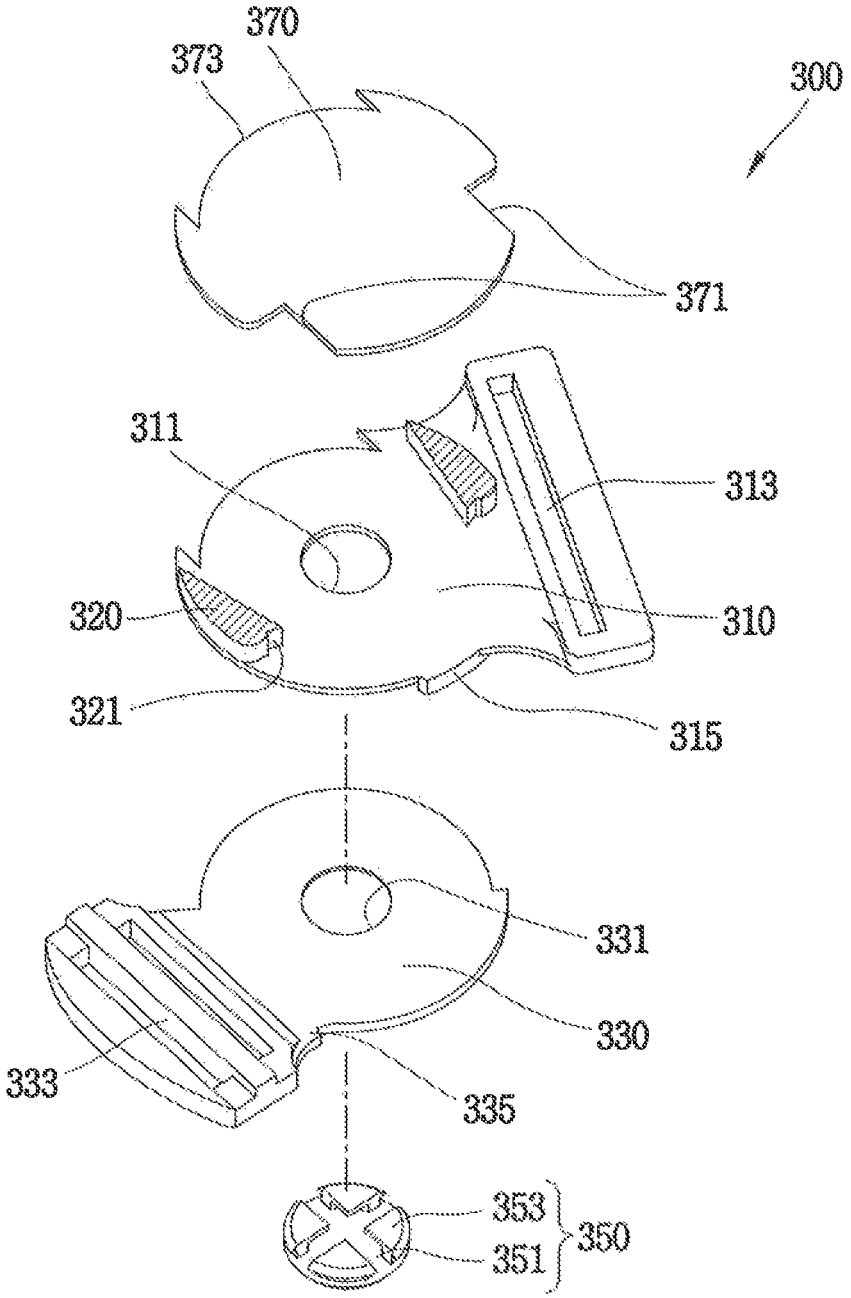

[FIG. 4]
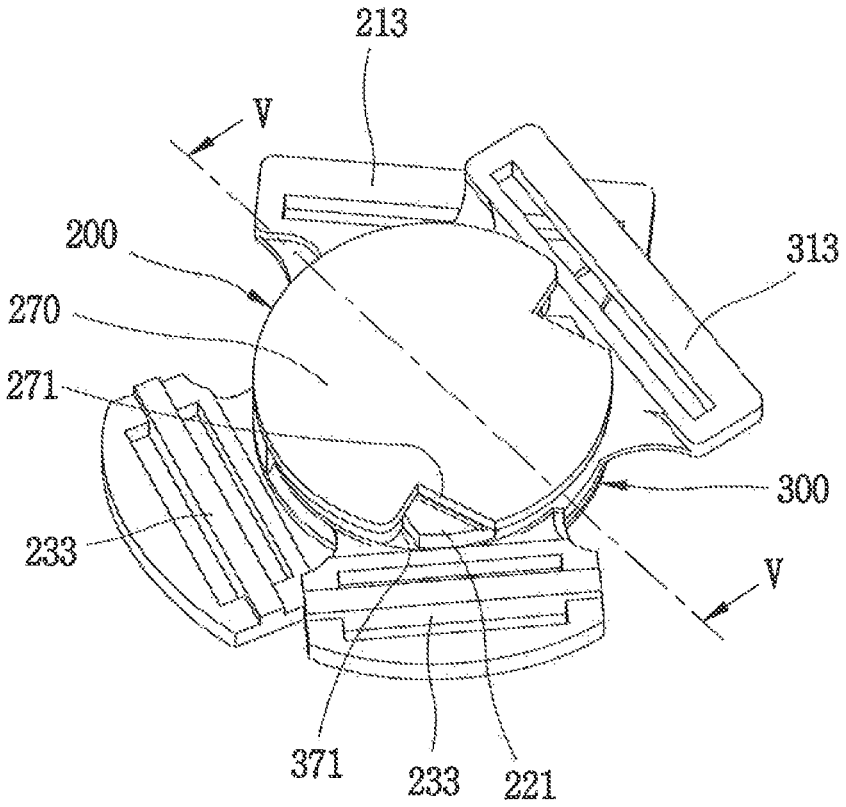

[FIG. 5]
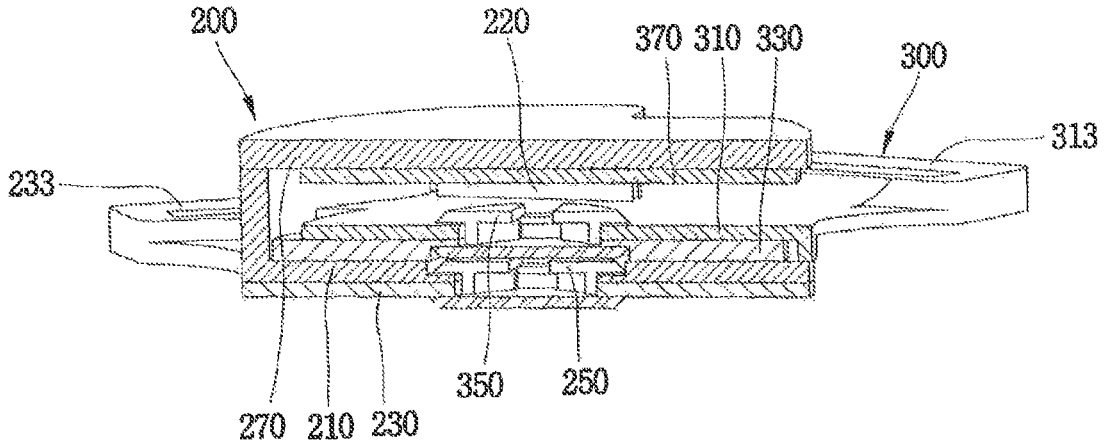

BAG HAVING ADJUSTABLE SHOULDER STRAP, SHOULDER STRAP ASSEMBLY AND PIVOTALLY CONNECTING DEVICE USED FOR THE SAME

This application is a National Stage completion of PCT/KR2013/008028 filed Sep. 5, 2013, which claims priority from Korean patent application serial no. 10-2012-0098352 filed Sep. 5, 2012.

TECHNICAL FIELD

The present invention relates to a bag with adjustable shoulder straps, and a shoulder strap assembly and a rotary type coupler for the same.

BACKGROUND ART

In general, bags may be largely classified into a handbag carried by a hand and a shoulder bag slung over a shoulder or shoulders.

Shoulder bags have been disclosed in Korean Utility Model No. 0392083 and the like. Those bags can be slung over shoulders by the shoulder straps.

In detail, shoulder straps make a ring shape in the entire form and both ends are coupled to the bag. A user puts on the bag by putting the arms through the rings made by shoulder straps such that the shoulder straps go over the shoulders.

This type, however, has a problem in that when the user wearing the bag runs, the shoulder straps come off and the bag slips down. Further, bags are considered as articles for carrying loads, so they are difficult to use for fashion.

DISCLOSURE

Technical Problem

An object of the present invention provides a bag with adjustable shoulder straps which can be used as a fashion item, with the shoulder straps in closer contact with the wearer's body, and a shoulder strap assembly and a rotary type coupler for the bag.

Technical Solution

According to an embodiment of the present invention, a bag with adjustable shoulder straps may include: an accommodating unit having an internal space capable of keeping an object; a first upper strap and a second upper strap that are connected to both sides of an upper portion of the accommodating unit, respectively; a first lower strap and a second lower strap that are connected to both sides of a lower portion of the accommodating unit; a first coupling module that couples the first upper strap to the first lower strap to be rotatable and has a first locking portion; and a second coupling module that couples the second upper strap to the second lower strap to be rotatable and has a second locking portion detachably locked to the first locking portion.

The first coupling module and the second coupling module each may further include: an upper plate that is connected to the first upper strap or the second upper strap; a lower plate that is connected to the first lower strap or the second lower strap; and a connecting pin that is disposed to face the lower plate from line upper plate and couples the upper plate to the lower plate to be rotatable.

The connecting pin may have: a head that is locked to the lower plate; and legs that extend from the head, are arranged through the lower plate and the upper plate, and are divided into plurality and locked to the upper plate.

The first locking portion may have a plug coupled to the upper plate of the first coupling module and having a plug with a hook at the free end, and the second locking portion may have a receptacle coupled to the upper plate of the second coupling module and locking the hook of the plug.

The first coupling module may further include a first cover disposed over the plug to cover the plug.

The plug may have a pair of the hooks disposed at both sides of the connecting pin, and the first cover may include a circular plate having a pair of cut-off portions corresponding to the pair of hooks and exposing the pair of hooks.

The second coupling module may further include a second cover disposed over the receptacle to cover the receptacle, and the second cover may include a circular plate having a pair of cut-off portions corresponding to the hooks and a third cut-off portion formed opposite to the pair of cut-off portions to correspond to the joint of the plug and the lower plate of the first coupling module.

With the first locking portion and the second locking portion locked, the second cover may be disposed between the first cover and the plug, and the upper plate and the lower plate of the second coupling module may be disposed between the upper plate and the plug of the first coupling module.

Any one of the first upper strap and the second upper strap may have: a band longitudinally extending; and a reinforcing part extending along the outer edge of the band and having a band shape protruding further than the other portion of the band.

Any one of the first upper strap and the second upper strap may have a folding part that is a cut-off portion formed on the inner edge of the band and allows the band to fold.

According to another embodiment of the present invention, a shoulder strap assembly includes: a first upper strap and a second upper strap; a first lower strap and a second lower strap; a first rotary unit that couples the first upper strap to the first lower strap to be rotatable; a second rotary unit that couples the second upper strap to the second lower strap to be rotatable; and a locking unit that is disposed at the first rotary unit and the second rotary unit and detachably locks the first rotary unit to the second rotary unit.

The first rotary unit and the second rotary unit each may include: an upper plate that is connected to the first upper strap or the second upper strap; a lower plate that is connected to the first lower strap or the second lower strap; and a connecting pin that is disposed to face the lower plate from the upper plate and couples the upper plate and the lower plate to be rotatable relative to each other.

The locking unit may include: a first locking portion that is coupled to the upper plate of the first rotary unit and has a plug with a hook at the free end; and a second locking portion that is coupled to the upper plate of the second rotary unit and has a receptacle for locking the hook of the plug.

With the first locking portion and the second locking portion locked, the upper plate and the lower plate of the second rotary unit may be disposed between the plug of the first locking portion and the upper plate of the first rotary unit.

According to another embodiment of the present invention, a rotary type coupler includes: a first coupling module having a first rotary unit coupling a first upper strap to a first lower strap to be rotatable, and a first locking portion coupled to the first rotary unit; and a second coupling module having a second rotary unit coupling a second upper strap to a second lower strap to be rotatable, and a second locking portion coupled to the second rotary unit and detachably locked to the first locking portion.

The first rotary unit and the second rotary unit each may include: an upper plate that is connected to the first upper strap or the second upper strap; a lower plate that is connected to the first lower strap or the second lower strap; and a connecting pin that couples the upper plate and the lower plate to be rotatable.

The first locking portion may have a plug coupled to the upper plate of the first rotary unit and having a nook at the free end, and the second locking portion may have a receptacle coupled to the upper plate of the second rotary unit and locking the hook of the plug.

With plug locked to the receptacle, the second rotary unit may be disposed between the plug and the first rotary unit.

The upper plate of the second coupling module may have an upper stopper, and the lower plate of the second coupling module may have a lower stopper that is locked to the upper stopper and restricts rotation relative to the upper plate of the second coupling module, with the plug locked to the receptacle.

Advantageous Effects

According to a bag with adjustable shoulder straps, and a shoulder strap assembly and a rotary type coupler for the bag, the shoulder straps can come in closer contact with the wearer's body, and the shoulder straps and the bag can be fashion items.

DESCRIPTION OF DRAWINGS

FIGS. 1A and 1B are perspective views illustrating a user with a bag 100 with adjustable shoulder straps according to an embodiment of the present invention.

FIG. 2 is an exploded perspective view of a first coupling module 200 illustrated in FIG. 1.

FIG. 3 is an exploded perspective view of a second coupling module 300 illustrated in FIG. 1.

FIG. 4 is a perspective view illustrating an assembly of the first coupling module 200 and the second coupling module 300 illustrated in FIG. 1.

FIG. 5 is a cross-sectional view taken along line V-V illustrated in FIG. 4 and illustrating the assembly of the first coupling module 200 and the second coupling module 300.

BEST MODE

Hereinafter, a bag with adjustable shoulder straps, and a shoulder strap assembly and a rotary type coupler for the bag according to an embodiment of the present invention will be described in detail with reference to the accompanying drawings. The same and like reference numerals are used for the same and like components herein even in different embodiments and the latter description refers to the earlier description.

FIGS. 1A and 1B are perspective views illustrating a user with a bag 100 with adjustable shoulder straps according to an embodiment of the present invention.

Referring to FIGS. 1A and 1B, a bag 100 with adjustable shoulder straps may include an accommodating unit 110, upper straps 131 and 151, lower straps 136 and 156, a first coupling module 200, and a second coupling module 300.

The accommodating unit 110 has an internal space capable of keeping an object. The accommodating unit 110 may have a substantially hexagonal shape and is placed on the wearer's back.

The upper straps 131 and 151 are connected to both sides of an upper portion of the accommodating unit 110 and constitute a shoulder strap assembly. The upper straps 131 and 151, in detail, may be a first upper strap 131 for the right shoulder of a wearer and a second upper strap 151 for the left shoulder of a wearer.

The second upper strap 151 of the upper straps 131 and 151 is stated as an example in the following description for convenience. The second upper strap 151 may include a band 152, a reinforcing part 153, and a folding part 155. The band 152 may be a part extending longitudinally and having a substantially rectangular cross-section. The band 152 may be made of cloth and may have a material for cushion therein. The reinforcing part 153 protrudes outward from the band 152 with respect to a wearer and longitudinally extends. The reinforcing part 153 may have the shape of a band protruding further than other portion of the band 152. The folding part 155 is formed at the inner edge of the band 152 so that the band 152 can fold. To this end, the folding part 155 may be cut in a substantially triangular shape.

The lower straps 136 and 156 are connected to both sides of a lower portion of the accommodating unit 110 and constitute the shoulder strap assembly with the upper straps 131 and 151. The lower straps 136 and 156, in detail, may be a first lower strap 136 for the right side of a wearer and a second lower strap 156 for the left side of a wearer.

The first coupling module 200 couples the first upper strap 131 and the first lower strap 136 such that they can rotate. Similar to the first coupling module 200, the second coupling module 300 couples the second upper strap 151 and the second lower strap 156 such that they can rotate.

A combination of the upper straps 131 and 151, the lower straps 136 and 156, the first coupling module 200, and the second coupling module 300 may be called the shoulder strap assembly. The shoulder strap assembly is the part that starts at the wearer's shoulders and goes to the sides across the chest and the belly, in the bag 100. The first coupling module 200 and the second coupling modules 300 that make the shoulder strap assembly adjustable (rotate a part relative to another part) may be called rotary type couplers.

According to this configuration, as illustrated in FIG. 1A, the shoulder strap assembly may be arranged in a first mode with the straps substantially in parallel in the entire form. This corresponds to a typical case when a user wears the bag 100.

Referring to FIG. 1B, the shoulder strap assembly may be arranged in a second mode in an X-shape in the entire form. For the second mode, the first module 200 is coupled to the second module 300. Accordingly, the first upper strap 131 is arranged substantially in a line (first line) with the second lower strap 156 and the second upper strap 151 is arranged substantially in another line with the first lower strap 136. The first line and the second line make the X-shape in the entire form.

The first coupling module 200 and the second coupling module 300 are not arranged in parallel (horizontally), but overlap perpendicular to the wearer's belly (or chest). Accordingly, the shoulder strap assembly can make a more complete X-shape.

In this configuration, the bag 100 can be changed into the first mode and the second mode. Accordingly, a wearer can simply wear the bag 100 in a first mode in normal times, and he/she can change the bag 100 into the second mode when he/she needs to run or the bag 100 is heavy. In the second mode, the bag 100 is in closer contact with the wearer, it made the wearer more comfortable. The reinforcing part 153 prevents the band 152 from coming off the shoulder of the wearer due to a load concentrated on the outer side of the band 152. Further, the folding part 155 allows the band 152 to fold only at the folding part 155 without the inner side of the band 152 coming off the wearer's shoulder.

In this configuration, the first coupling module 200 and the second coupling module 300 may be new fashion accessories in both of the first mode and the second mode, in comparison to the existing simple shoulder straps. The material of the first coupling module 200 and the second coupling module 300 may be different from that of the upper straps 131 and 151 and the lower straps 136 and 156 and the bag 100 may have a fashion feature in that additional accessories can be attached to the first coupling module 200 and the second coupling module 300.

The first coupling module 200 and the second coupling module 300 are described in detail with reference to FIGS. 2 and 3, respectively.

FIG. 2 is an exploded perspective view of the first coupling module 200 illustrated in FIG. 1.

Referring to FIG. 2, the first coupling module 200 may include an upper plate 210, a first locking portion 220, a lower plate 230, a connecting pin 250, and a first cover 270. A combination of the upper plate 210, lower plate 230, and a connecting pin 250 may be called a first rotary unit.

The upper plate 210 has a hole 211 at the center and an upper connecting portion 213 at the edge. The connecting pin 250 is inserted in the hole 211 and the upper connecting portion 213 is connected to the first upper strap 131.

The first locking portion 220 is formed on the upper surface (the side opposite to the side facing the lower plate 230) of the upper plate 210. The first locking portion 220 may have the shape of a plug. In detail, the plug may be divided into two portions and extended with the hole 211 therebetween. The two portions are separated from the upper plate 210 and hooks 221 may be formed at the free ends of the plug. The hooks 221 protrude laterally further than the other portion of the plug.

The lower plate 230 has a hole 231 at the center and a lower connecting portion 233 at the edge. The connecting pin 250 is inserted in the hole 231. The lower connecting portion 233 is connected to the first lower strap 136.

The connecting pin 250 is inserted in the hole 231 of the lower plate 230 and the hole 211 of the upper plate 210, so the upper plate 210 and the lower plate 230 are connected to rotate relative to each other. The connecting pin 250, in detail, may have a head 251 and legs 253. The head 251 may be a circular plate with an area larger than the hole 231 to be locked to the lower plate 230. The legs 253 extend perpendicularly from a side of the head 251. The legs 253 are closed to pass through the holes 231 and 211 and then opened to be locked to the upper plate 210. By the connecting pin 250, a process of combining the upper plate 210 and the lower plate 230 such that they can rotate relative to each other can be made simple.

The first cover 270, which covers the first coupling portion 220, may be disposed over the first coupling portion 220. In detail, the first cover 270 has the shape of a circular plate in the entire form. However, the first cover 270 may be cut-off portions 271 at two opposite portions, corresponding to the hooks 221.

Next, FIG. 3 is an exploded perspective view of the second coupling module 300 illustrated in FIG. 1.

Referring to FIG. 3, the second coupling module 300, similar to the first coupling module 200, may include an upper plate 310, a lower plate 330, a connecting pin 350, and a second cover 370. Further, the second coupling module 300 may have a second locking portion 320 corresponding to the first locking portion 220 of the first coupling module 200. A combination of the first locking portion 220 and the second locking portion 320 may be called a locking unit. Further, a combination of the upper plate 310, lower plate 330, and connecting pin 350 may be called a second rotary unit. The configuration of the second coupling module 300 that corresponds to the configuration of the first coupling module 200 is briefly described hereafter.

The upper plate 310 has a hole 311 and an upper connecting portion 313. The upper connecting portion 313 is connected to the second upper strap 151. The upper plate 310 may have an upper stopper 315 protruding on the edge.

The second locking portion 320 is formed in a receptacle type corresponding to the plug of the first looking portion 220. The receptacle may have two blocks spaced from each other on the upper plate 310. The two blocks are arranged to correspond to each other around the hole 311 and each may have a recessed locking groove 321. The locking groove 321 is sized to receive the hook 221 (in FIG. 2) of the first locking portion 220.

The lower plate 330 has a hole 331 and a lower connecting portion 333. The lower connecting portion 333 is connected to the second lower strap 156. The lower plate 330 can restrain a lower stopper 335 corresponding to the upper stopper 135. The lower stopper 335 is locked to the upper stopper 315 at a predetermined position while the upper plate 310 rotates relative to the lower plate 330.

The connecting pin 350 is inserted in the lower plate 330 and the upper plate 310 through the holes 331 and 311. Accordingly, the upper plate 310 and the lower plate 330 are coupled rotatably to each other.

The second cover 370 is disposed over the second locking portion 320 to cover it. The second cover 370, similar to the first cover 270, may have a pair of cut-off portion 371 for exposing the nocks 221 of the first locking portion 220. Further, the second cover 370 may further have a third cut-off portion 373 between the cut-off portions 371 to avoid the joint of the first locking portion 220 and the upper plate 210 (see FIG. 2).

An assembly of the first coupling module 200 and the second coupling module 300, which have been described above, is described with reference to FIGS. 4 and 5.

Herein, FIG. 4 is a perspective view illustrating an assembly of the first coupling module 200 and the second coupling module 300 illustrated in FIG. 1 and FIG. 5 is a cross-sectional view taken along line V-V illustrated in FIG. 4 and illustrating the assembly of the first coupling module 200 and the second coupling module 300.

Referring to the figures (and FIGS. 1A to 3), the first coupling module 200 and the second coupling module 300 are combined, as illustrated in FIG. 4, in the state illustrated in FIG. 1B.

For this combination, the upper plate 210 and the lower plate 230 of the first coupling module 200 that have been substantially in a line are rotated relative to each other. This motion is made by interaction of the upper plate 210, lower plate 230, and the connecting pin 250 that constitute the first rotary unit. Further, the upper plate 310 and the lower plate 330 of the second coupling module 300 that have been substantially in a line are also rotated relative to each other. This motion is made by interaction of the upper plate 310, lower plate 330, and the connecting pin 350 that constitute the second rotary unit. The relative rotation angle of the upper plate 310 and the lower plate 330 is determined by the angle where the upper stopper 315 is locked to the lower stopper 335. At the determined angle, the third cut-off portion 373 of the second cover 370 and the cut-off portion corresponding to the third cut-off portion 373 of the upper plate 330 are arranged. By this arrangement, the second coupling module 300 can be inserted into the first coupling module 200 without interference.

In order to combine the first coupling module 200 and the second coupling module 300, it is required to lock the first locking portion 220 and the second locking portion 320 that are locking units. In detail, the hooks 221 of the two plugs of the first coupling portion 220 are locked to the second locking portion 320, in detail, inserted in between two blocks and then opened and locked to the locking grooves 321. Accordingly, the first locking portion 220 is positioned at substantially the same height as the second locking portion 320.

Unlikely, the second cover 370 is disposed under the first cover 270 and the second rotary unit is disposed between the first locking portion 220 and the first rotary unit. Accordingly, the second coupling module 300 may be considered as being inserted in the first coupling module 200.

According to this configuration, the first coupling module 200 and the second coupling module 300 are not horizontally opened, but perpendicularly overlapped, so the shoulder strap assembly can make a more complete X-shape. Further, since the lower plate 330 and the upper plate 310 of the first coupling module 200 are in contact with the belly (or chest) of a wearer, the wearer can recognize the rotary type coupler as little as possible.

In order to return to the first mode (illustrated in FIG. 1A) from the second mode (illustrated in FIG. 1B), the wearer has only to pull the pair of hooks 221 of the first coupling portion toward each other. Accordingly, the pair of hooks 221 are unlocked from the second locking portion 230 and the first coupling module 200 is separated from the second coupling module 300. Therefore, the bag 100 returns to the first mode.

The bag with adjustable shoulder straps, and a shoulder strap assembly and a rotary type coupler for the bag are not limited to in configuration and operation to the embodiments described above. The embodiments may be selectively partially or fully combined for various modifications.

The invention claimed is:

1. A bag with adjustable shoulder straps, comprising:

an accommodating unit having an internal space capable of keeping an object;

a first upper strap and a second upper strap connected to both sides of an upper portion of the accommodating unit, respectively;

a first lower strap and a second lower strap connected to both sides of a lower portion of the accommodating unit;

a first coupling module coupling the first upper strap to the first lower strap to be rotatable and having a first locking portion; and a second coupling module coupling the second upper strap to the second lower strap to be rotatable and having a second locking portion detachably locked to the first locking portion wherein the first coupling module and the second coupling module each further include:

an upper plate connected to the first upper strap or the second upper strap; a lower plate connected to the first lower strap of the second lower strap; and a connecting pin disposed to face the lower plate from the upper plate and coupling the upper plate to the lower plate to be rotatable; and the first locking portion has a plug coupled to the upper plate of the first coupling module and has a hook at the free end, and the second locking portion has a receptacle coupled to the upper plate of the second coupling module and locking the hook of the plug.

2. The bag of claim 1, wherein the connecting pin has:

a head locked to the lower plate; and legs extending from the head, arranged through the lower plate and the upper plate, and divided into plurality and locked to the upper plate.

3. The bag of claim 1, wherein the first coupling module further includes a first cover disposed over the plug to cover the plug.

4. The bag of claim 3, wherein the plug has a pair of the hooks disposed at both sides of the connecting pin, and the first cover includes a circular plate having a pair of cut-off portions corresponding to the pair of hooks and exposing the pair of hooks.

5. The bag of claim 4, wherein the second coupling module further includes a second cover disposed over the receptacle to cover the receptacle, and the second cover includes a circular plate having a pair of cut-off portions corresponding to the pair of hooks and a third cut-off portion formed opposite to the cut-off portions to correspond to a joint of the plug and the lower plate of the first coupling module.

6. The bag of claim 5, wherein with the first locking portion and the second locking portion locked, the second cover is disposed between the first cover and the plug, and the upper plate and the lower plate of the second coupling module are disposed between the upper plate and the plug of the first coupling module.

7. The bag of claim 1, wherein any one of the first upper strap and the second upper strap has:

a band longitudinally extending; and a reinforcing part extending along an outer edge of the band and having a band shape protruding further than the other portion of the band.

8. The bag of claim 7, wherein any one of the first upper strap and the second upper strap further has a folding part being a cut-off portion formed on the inner edge of the band and allowing the band to fold.

9. A shoulder strap assembly comprising:

a first upper strap and a second upper strap;

a first lower strap and a second lower strap;

a first rotary unit coupling the first upper strap to the first lower strap to be rotatable;

a second rotary unit coupling the second upper strap to the second lower strap to be rotatable; and a locking unit disposed at the first rotary unit and the second rotary unit and detachably locking the first rotary unit to the second rotary unit, wherein the first rotary unit and the second rotary unit each include:

an upper plate connected to the first upper strap or the second upper strap;

a lower plate connected to the first lower strap or the second lower strap; and a connecting pin disposed to face the lower plate from the upper plate and coupling the upper plate and the lower plate to be rotatable relative to each other; and the locking unit includes:

a first locking portion coupled to the upper plate of the first rotary unit and having a plug with a hook at the free end; and a second locking portion coupled to the upper plate of the second rotary unit and having a receptacle for locking the hook of the plug.

10. The shoulder strap assembly of claim 9, wherein with the first locking portion and the second locking portion locked, the upper plate and the lower plate of the second rotary unit are disposed between the plug of the first locking portion and the upper plate of the first rotary unit.

11. A rotary type coupler comprising:

a first coupling module having a first rotary unit coupling a first upper strap to a first lower strap to be rotatable, and a first locking portion coupled to the first rotary unit; and a second coupling module having a second rotary unit coupling a second upper strap to a second lower strap to be rotatable, and a second locking portion coupled to the second rotary unit and detachably locked to the first locking portion;

wherein the first rotary unit and the second rotary unit each include:

an upper plate connected to the first upper strap or the second upper strap;

a lower plate connected to the first lower strap or the second lower strap; and a connecting pin disposed to face the lower plate from the upper plate and coupling the upper plate and the lower plate to be rotatable; and the first locking portion has a plug coupled to the upper plate of the first rotary unit and having a hook at the free end, and the second locking portion has a receptacle coupled to the upper plate of the second rotary unit and locking the hook of the plug.

12. The rotary type coupler of claim 11, wherein with the plug locked to the receptacle, the second rotary unit is disposed between the plug and the first rotary unit.

13. The rotary type coupler of claim 11, wherein the upper plate of the second coupling module has an upper stopper, and the lower plate of the second coupling module has a lower stopper locked to the upper stopper and restricting rotation relative to the upper plate of the second coupling module, with the plug locked to the receptacle.

* * * * *